US010801433B2

(12) United States Patent
Girardi et al.

(10) Patent No.: US 10,801,433 B2
(45) Date of Patent: Oct. 13, 2020

(54) SYSTEMS AND METHODS FOR DETERMINING IRREGULAR FUEL REQUESTS DURING ENGINE IDLE CONDITIONS

(71) Applicant: GM GLOBAL TECHNOLOGY OPERATIONS LLC, Detroit, MI (US)

(72) Inventors: Nicholas Girardi, Milford, MI (US); Neil Anderson, Howell, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 233 days.

(21) Appl. No.: 15/960,893

(22) Filed: Apr. 24, 2018

(65) Prior Publication Data

US 2019/0323446 A1 Oct. 24, 2019

(51) Int. Cl.

| | |
|---|---|
| ***F02D 41/22*** | (2006.01) |
| ***F02D 41/08*** | (2006.01) |
| ***G07C 5/08*** | (2006.01) |

(52) U.S. Cl.

CPC ..... *F02D 41/22* (2013.01); *F02D 41/08* (2013.01); *G07C 5/0816* (2013.01); *F02D 2200/06* (2013.01); *F02D 2200/101* (2013.01); *F02D 2200/501* (2013.01); *F02D 2200/502* (2013.01)

(58) Field of Classification Search

CPC ..... F02D 41/08; F02D 41/022; F02D 31/008; F02D 41/22; F02D 2200/00; F02D 2200/101; F02D 2200/06; F02N 11/0818; G07C 5/0816

See application file for complete search history.

(56) References Cited

U.S. PATENT DOCUMENTS

| | | | | | |
|---|---|---|---|---|---|
| 3,664,316 | A * | 5/1972 | Garcea | F02B 27/00 | 123/585 |
| 4,029,071 | A * | 6/1977 | Saito | F02M 59/22 | 123/447 |
| 4,346,682 | A * | 8/1982 | Mader | F02M 3/062 | 123/179.16 |
| 4,864,997 | A * | 9/1989 | Miyachi | F02D 31/008 | 123/674 |
| 6,062,194 | A * | 5/2000 | Schwarz | F02M 45/06 | 123/299 |
| 6,085,717 | A * | 7/2000 | Kamura | F02D 17/02 | 123/295 |

(Continued)

*Primary Examiner* — Mussa A Shaawat

(57) ABSTRACT

Methods for determining an irregular fuel request (IFR) for vehicle engines coupled to driveshafts via clutched transmissions are provided and include: determining an idle condition of the engine, generating one or more fuel requests during the idle condition, and determining an IFR based on a clutch control parameter and a fuel request generated during the idle condition. The idle condition of the engine is determined based on a vehicle speed and an engine speed if the vehicle speed and engine speed are below respective thresholds. An IFR is determined if a fuel request falls outside a range, and/or if the clutch control parameter is such that the clutch does not substantially impart load to the engine. The idle fuel request range is determined based on a combustion mode of the engine and/or a gear state of the transmission. The method further includes implementing a control action after determining an IFR.

20 Claims, 2 Drawing Sheets

(56) References Cited

U.S. PATENT DOCUMENTS 6,109,236 A * 8/2000 Takahashi ..... F02D 31/003 123/339.19
6,155,242 A * 12/2000 Kotwicki ..... F02D 41/1401 123/681
6,340,016 B1 * 1/2002 Ueda ..... F02D 19/061 123/305
7,174,713 B2 * 2/2007 Nitzke ..... F02D 41/0007 123/568.21
9,353,696 B2 * 5/2016 Midlam-Mohler ..... F02D 41/1401
2003/0100401 A1 * 5/2003 Kim ..... B60W 10/06 477/107
2003/0172903 A1 * 9/2003 Perez Carballo ..... F02D 31/008 123/333
2004/0094124 A1 * 5/2004 Viele ..... F02D 35/021 123/406.27
2004/0103647 A1 * 6/2004 Yomogida ..... F02D 41/0245 60/284
2006/0254562 A1 * 11/2006 Akita ..... B60K 6/445 123/431
2008/0046128 A1 * 2/2008 Sasaki ..... F02D 35/026 700/274
2008/0066724 A1 * 3/2008 Klingebiel ..... F02D 41/405 123/568.12
2009/0216429 A1 * 8/2009 Yamashita ..... F02D 13/0226 701/107
2010/0139623 A1 * 6/2010 Mori ..... F02D 31/008 123/493
2012/0065868 A1 * 3/2012 Ando ..... F02D 41/221 701/103
2012/0150774 A1 * 6/2012 Yamada ..... F02D 41/2467 706/12
2016/0017825 A1 * 1/2016 Maeda ..... F02D 41/022 701/58
2018/0347534 A1 * 12/2018 Lebreux ..... F02D 41/064
2020/0056559 A1 * 2/2020 Lebreux ..... F02N 3/02
2020/0080505 A1 * 3/2020 Lebreux ..... F02D 41/062

* cited by examiner

SYSTEMS AND METHODS FOR DETERMINING IRREGULAR FUEL REQUESTS DURING ENGINE IDLE CONDITIONS

INTRODUCTION

Internal combustion engines combust a fuel and air mixture within cylinders driving pistons to produce drive torque. The engine drives a transmission through a coupling device. The engine also drives other loads including, but not limited to, an alternator, a plurality of pumps (e.g., oil and coolant) and an A/C compressor. The engine is operated based on a desired air-to-fuel (A/F) ratio. In some instances, the A/F ratio is lean (i.e., reduced fuel) and in other instances, the A/F ratio is rich (i.e., increased fuel). An ignition system initiates combustion of the A/F mixture within cylinders. During vehicle operation, periods of engine idle occur. Engine idle occurs when the vehicle is at or near zero speed and there is no operator throttle input (i.e., operator not revving the engine). Engine idle can be monitored to identify undesired operating conditions. During engine idle, irregular idle can occur, whereby the engine speed bounces or drops below a threshold level, resulting in engine stall. Rough idle detracts from vehicle quality and customer satisfaction.

SUMMARY

An engine idle management system of a vehicle is provided. The system includes an engine coupled to a driveshaft via a transmission. The transmission includes a clutch. The system further includes a controller which can determine an idle condition of the engine, generate fuel requests during the idle condition, and determine an irregular fuel request (IFR) during the idle condition based on a clutch control parameter and a fuel request generated during the idle condition. The controller can be configured to determine the idle condition of the engine based on a vehicle speed and an engine speed. The controller can be configured to determine the idle condition of the engine if a vehicle speed is below a vehicle speed threshold and an engine speed is below an engine speed threshold. The controller can be configured to determine an IFR if a fuel request falls outside an idle fuel request range. The idle fuel request range can be determined based on one or more of a combustion mode of the engine, and a gear state of the transmission. The controller can be configured to determine an IFR if the clutch control parameter is such that the clutch does not substantially impart load to the engine. The controller can be configured to determine an IFR if the clutch is fully engaged and the vehicle transmission is in neutral. The controller can be configured to determine an IFR if a fuel request during the idle condition falls outside an idle fuel request range and a clutch control parameter is below a clutch control parameter threshold. The controller can be configured to implement a control action subsequent to determining an IFR. The control action can include notifying a vehicle operator of the IFR.

A method for determining an irregular fuel request (IFR) for an engine of a vehicle is provided. The engine can be coupled to a driveshaft via a transmission and the transmission can include a clutch. The method includes determining an idle condition of the engine, generating one or more fuel requests during the idle condition, and determining an IFR based on a clutch control parameter and a fuel request generated during the idle condition. The idle condition of the engine can be determined based on a vehicle speed and an engine speed. The idle condition of the engine can be determined if a vehicle speed is below a vehicle speed threshold and an engine speed is below an engine speed threshold. A IFR can be determined if a fuel request falls outside an idle fuel request range. The idle fuel request range can be determined based on one or more of a combustion mode of the engine, and a gear state of the transmission. A IFR can be determined if the clutch control parameter is such that the clutch does not substantially impart load to the engine. An IFR can be determined if the clutch is fully engaged and the vehicle transmission is in neutral. An IFR can be determined if a fuel request during the idle condition falls outside an idle fuel request range and a clutch control parameter is below a clutch control parameter threshold. The method can further include implementing a control action subsequent to determining an IFR. The control action can be notifying a vehicle operator of the IFR.

The details of one or more examples are set forth in the accompanying drawings and the description below. Other features, objects, and advantages will be apparent from the description and drawings, and from the claims.

DETAILED DESCRIPTION

Figure 1:
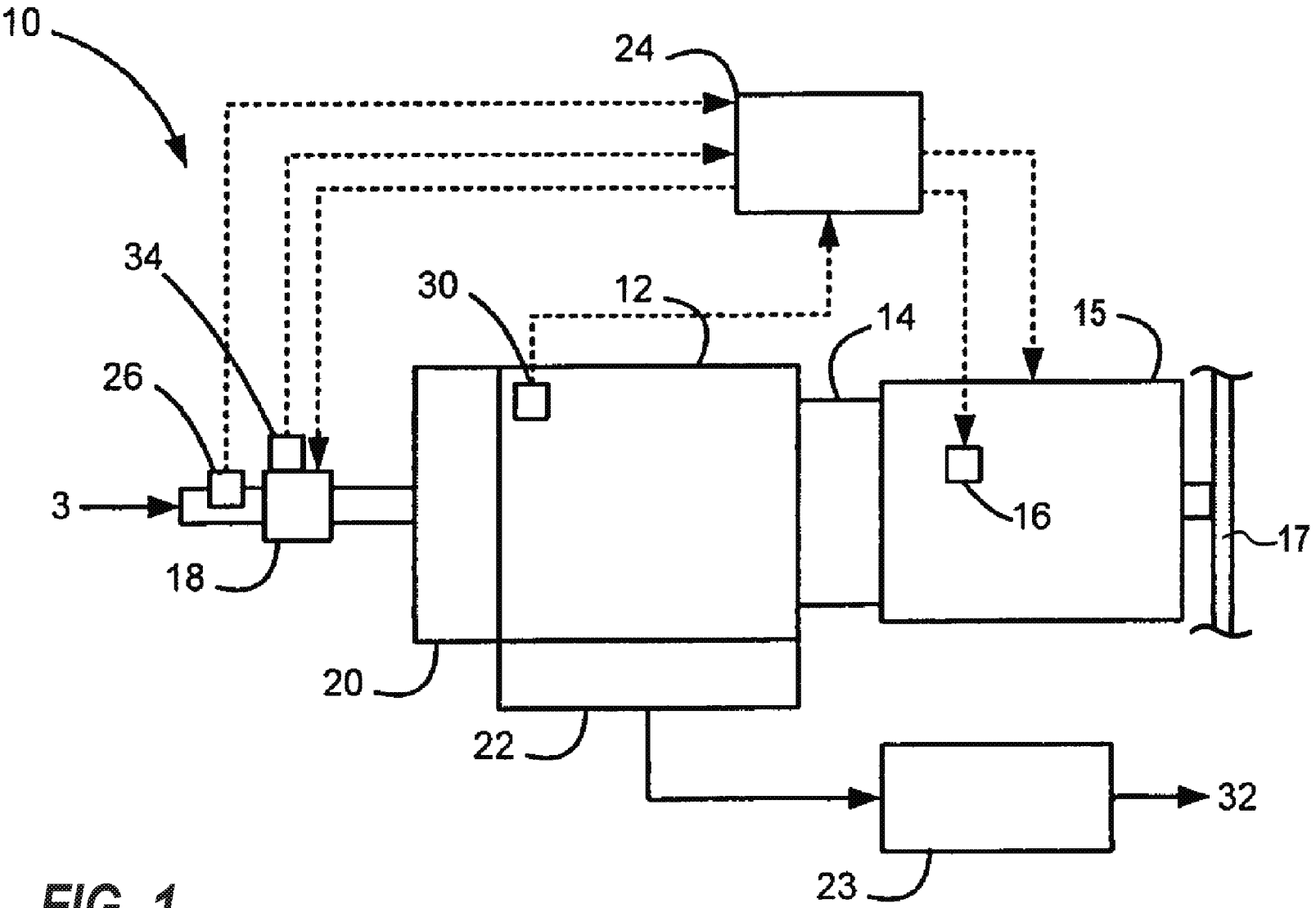
FIG. 1 illustrates a schematic view of a vehicle system, according to one or more embodiments.

The present invention is described with reference to the attached figures, wherein like reference numerals are used throughout the figures to designate similar or equivalent elements. The figures are not drawn to scale and they are provided merely to illustrate the invention. Several aspects of the invention are described below with reference to example applications for illustration. It should be understood that numerous specific details, relationships, and methods are set forth to provide an understanding of the invention. One skilled in the relevant art, however, will readily recognize that the invention can be practiced without one or more of the specific details or with other methods. In other instances, well-known structures or operations are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

The following description of the preferred embodiment is merely exemplary in nature and is in no way intended to limit the invention, its application, or uses. For purposes of clarity, the same reference numbers will be used in the drawings to identify similar elements. As used herein, the term controller refers to an application specific integrated circuit (ASIC), an electronic circuit, a processor (shared, dedicated, or group) and memory that execute one or more software or firmware programs, a combinational logic circuit, and/or other suitable components that provide the described functionality.

Referring now to FIG. 1, an example vehicle system 10 is illustrated for the purposes of describing the methods below. It is to be understood that vehicle systems of varying configurations and components are considered germane to the embodiments disclosed herein. The vehicle system 10 includes an engine 12 that drives a transmission 15 through a torque converter 14. The transmission can be a manual transmission. The transmission 15 can be selectively coupled a driveshaft 17 via a clutch, the condition of which can be monitored by clutch sensor 16. The clutch may be engaged/disengaged by a clutch pedal (not shown). The driveshaft 17 can be coupled to, and power one or more wheels (not shown), for example. Clutch sensor 16 can determine and/or communicate a clutch control parameter and transmit the same to the controller 24. A clutch control parameter can indicate whether the clutch is engaged or disengaged. Additionally or alternatively, a clutch control parameter can indicate the degree to which the clutch is engaged or disengaged. Air 3 is drawn through a throttle 18 into an intake manifold 20, which distributes air to cylinders (not shown). The throttle may be controlled by one or more of the controller 24, as described below, and an accelerator pedal (not shown). The air is mixed with fuel at a desired air-to-fuel (A/F) ratio and the A/F mixture is combusted within the cylinders to generate drive torque. The combustion products are exhausted from the engine 12 through an exhaust manifold 22 and can be treated in a catalytic converter 23, for example, before being released to atmosphere 32.

A controller 24 regulates operation of the engine 12 based on various engine operating parameters, for example such as one or more sensors appurtenant to the vehicle system 10. For example, vehicle system 10 can include a mass air flow (MAF) sensor 26 which generates a MAF signal based on the MAF into the engine 12. Additionally or alternatively, vehicle system 10 can include an engine RPM sensor 30 which generates a RPM signal based on the rotational velocity of a crankshaft (not shown) of the engine 12, and communicates the same to the controller 24. Additionally or alternatively, vehicle system 10 can include a throttle position sensor 34 which generates a throttle position signal and communicates the same to the controller 24.

The controller 24 can generate a fuel request based on or more factors and control the throttle based on said one or more factors. In some embodiments, the controller 24 can generate a fuel request based on an accelerator pedal position, or controller 24 logic configured to achieve various vehicle objectives. For example, in certain vehicle operating conditions (e.g., idle), controller 24 may generate fuel requests to achieve a desired engine speed. The controller is configured to determine an idle condition of the engine 12 based on a vehicle speed and an engine 12 speed. Specifically, the controller 24 can determine an idle condition if the engine 12 speed is below an engine 12 speed threshold (e.g., 1,600 RPM) and the vehicle speed is below a threshold vehicle speed (e.g., a vehicle speed of 3 kilometers per hour or less). In some embodiments, the controller 24 can determine an idle condition if the engine 12 speed is within an engine 12 speed idle range (e.g., 400 RPM to 1,600 RPM) and the vehicle speed is below a threshold vehicle speed (e.g., a vehicle speed of 3 kilometers per hour or less). If the engine RPM falls below a lower Engine speed threshold, above an upper Engine speed threshold, and/or outside of a desired RPM range, the controller can adjust the engine 12 RPM back to a desired value (i.e., an RPM within the desired RPM range), for example by generating a fuel request. The desired range can comprise one or more of an upper Engine speed threshold and a lower Engine speed threshold.

The engine idle fault detection control system of the present disclosure monitors and/or controls the fuel requests at idle, and is configured to determine an irregular fuel request (IFR). An IFR is a fuel request which falls outside an idle fuel request range. The engine idle fault detection control system can initiate a control action if an IFR occurs during idle.

Figure 2:
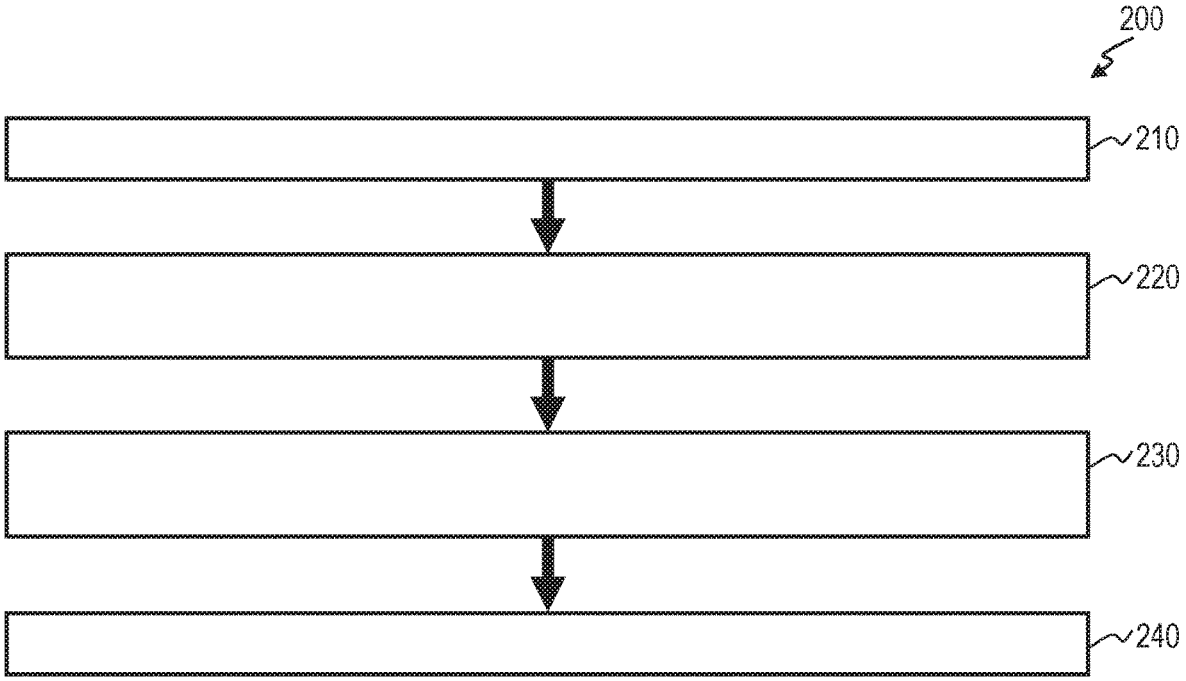
FIG. 2 illustrates a method for detecting a rough idle condition of an engine of a vehicle, according to one or more embodiments.

In many vehicle systems, particularly in vehicle systems comprising manual transmissions, engaging the clutch applies additional load to the engine which can increase the fuel request generated by the controller 24. Accordingly, if a clutch is engaged during an idle condition of the engine, an IFR may be improperly identified. Disclosed herein are methods for determining an IFR for an engine of a vehicle during an idle condition. The methods will be described in relation to system 10 for the sake of illustration, but are not intended to be limited thereby. Controller 24 and system 10 are similarly configured to implement all disclosed methods. FIG. 2 illustrates a method 200 for determining an IFR of an engine of a vehicle, such as vehicle system 10 wherein the engine 12 is coupled to a driveshaft 17 via a transmission 15 which comprises a clutch, as described above. Method 200 comprises determining 210 an idle condition of the engine, generating 220 one or more fuel requests during the idle condition, and determining 230 an IFR based on the clutch control parameter and a fuel request generated during the idle condition. Method 200 can optionally further comprise implementing 240 a control action subsequent to determining an IFR during an idle condition. Accordingly, method 200 includes a controller configured to determine an idle condition of the engine, generate one or more fuel requests during the idle condition, determine an IFR based on the clutch control parameter and a fuel request generated during the idle condition, determine a clutch control parameter, and optionally implement a control action in response to determining an IFR during the idle condition.

An idle condition of the engine can be determined 210 based on a vehicle speed, and an engine speed. In particular, an idle condition of the engine can be determined 210 if a vehicle speed is below a vehicle speed threshold and an engine speed is below an engine speed threshold. In some embodiments, an idle condition of an engine is determined 210 only when the accelerator pedal is not engaged. The engine speed of the engine during the idle condition can be determined via the engine RPM sensor 30, for example, or based on other methods which are known in the art. In some embodiments, an idle condition of the engine can be determined 210 based on a vehicle speed, a vehicle speed, and a clutch control parameter. In particular, an idle condition of the engine can be determined 210 if a vehicle speed is below a vehicle speed threshold, an engine speed is below an engine speed threshold, and a clutch control parameter is below a clutch control threshold. For example, an idle condition of the engine can be determined 210 if the clutch is only partially engaged, but is engaged to an extent which registers below the clutch control threshold. In some embodiments, an idle condition of the engine can only be determined 210 if the clutch is disengaged. Similarly, in such embodiments, an idle condition of the engine will not be determined 210 if the clutch is engaged.

One or more fuel requests can be generated 220 during the idle condition as described above. An IFR can be determined 230 based on the clutch control parameter and a fuel request generated during the idle condition if a fuel request falls outside an idle fuel request range and the clutch control parameter is such that the clutch does not substantially impart load to the engine (e.g., the level of clutch engagement does not increase, or substantially increase, a fuel request generated by the controller 24). The idle fuel request range can be determined based on one or more of a combustion mode of the engine 12 and a gear state (e.g., neutral)

of the transmission. A combustion mode of the engine 12 can include modes such as normal mode, and exhaust warmup mode, for example. For a given combustion mode, one or more variables may impact the idle fuel request range such as fuel rail pressure, fuel injection quantity, and injection pattern (e.g., the number of injection pulses per cylinder per revolution, or the timing of injection pulses relative to a cylinder position), among others. The idle fuel request range for a given operating condition or operating conditions (e.g., combustion mode and gear state) can be defined by a lookup table. One or a plurality of lookup tables may be utilized to define the idle fuel request range for all desired operating conditions. The one or more lookup tables may be stored in memory accessible by the controller 24.

When the clutch control parameter is such that the clutch imparts sufficient load to the engine and the fuel request is responsively adjusted outside of the fuel request range, no IFR will be determined 230. A clutch control parameter threshold may be defined wherein an IFR is determined 230 if a fuel request during the idle condition falls outside an idle fuel request range and a clutch control parameter is below a clutch control parameter threshold, or outside of a clutch control parameter range. In the case where a clutch control parameter is below a clutch control parameter threshold, the clutch control parameter threshold is a maximum threshold, wherein clutch engagement is low or the clutch is fully disengaged. The clutch control parameter can comprise an engagement magnitude of the clutch, or a clutch pedal position, for example. In some embodiments, an IFR can be determined 230 if a fuel request during the idle condition falls outside an idle fuel request range and the clutch is fully engaged while the vehicle transmission is in neutral.

Implementing 240 a control action can comprise notifying a vehicle operator of the determined 230 IFR. Notifying the vehicle operating can be accomplished using an auditory signal (e.g., sounding a horn, alarm, etc.), a visual signal (e.g., illuminating a dashboard indicator), or a physical signal (e.g., activating a vibrating device within a steering wheel, seat, armrest, pedal, or other area of a vehicle cabin), among others. Notifying the vehicle operator can be accomplished by means which are discernible inside and/or outside of a vehicle cabin. In some embodiments, a control action will only be implemented 240 if a certain threshold number of IFRs are determined 230. For example, a control action may only be implemented 240 if two or more IFRs are determined 230. In another example, a control action may only be implemented 240 if two or more IFRs are determined 230 in two discrete vehicle operating instances. One or more determined 230 IFRs may be logged in a memory accessible by controller 24 to track accumulated IFR instances such that a control action may be properly implemented 240. In some embodiments, only one IFR may be determined 230 within a given time frame (e.g., 100 milliseconds).

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. An engine idle management system of a vehicle, comprising:

an engine coupled to a driveshaft via a transmission, wherein the transmission comprises a clutch;

a controller configured to:

determine an idle condition of the engine, generate fuel requests during the idle condition; and determine an irregular fuel request (IFR) during the idle condition based on a clutch control parameter and a fuel request generated during the idle condition.

2. The engine idle management system of claim 1, wherein the controller is configured to determine the idle condition of the engine based on a vehicle speed and an engine speed.

3. The engine idle management system of claim 1, wherein the controller is configured to determine the idle condition of the engine if a vehicle speed is below a vehicle speed threshold and an engine speed is below an engine speed threshold.

4. The engine idle management system of claim 1, wherein the controller is configured to determine an IFR if a fuel request falls outside an idle fuel request range.

5. The engine idle management system of claim 4, wherein the idle fuel request range is determined based on one or more of a combustion mode of the engine, and a gear state of the transmission.

6. The engine idle management system of claim 1, wherein the controller is configured to determine an IFR if the clutch control parameter is such that the clutch does not substantially impart load to the engine.

7. The engine idle management system of claim 1, wherein the controller is configured to determine an IFR if the clutch is fully engaged and the transmission is in neutral.

8. The engine idle management system of claim 1, wherein the controller is configured to determine an IFR if a fuel request during the idle condition falls outside an idle fuel request range and a clutch control parameter is below a clutch control parameter threshold.

9. The engine idle management system of claim 1, wherein the controller is configured to implement a control action subsequent to determining an IFR.

10. The engine idle management system of claim 9, wherein the control action comprises notifying a vehicle operator of the IFR.

11. A method for determining an irregular fuel request (IFR) for an engine of a vehicle, wherein the engine is coupled to a driveshaft via a transmission wherein the transmission comprises a clutch, the method comprising:

determining an idle condition of the engine;

generating one or more fuel requests during the idle condition; and determining an IFR based on a clutch control parameter and a fuel request generated during the idle condition.

12. The method of claim 11, wherein the idle condition of the engine is determined based on a vehicle speed and an engine speed.

13. The method of claim 11, wherein the idle condition of the engine is determined if a vehicle speed is below a vehicle speed threshold and an engine speed is below an engine speed threshold.

14. The method of claim 11, wherein an IFR is determined if a fuel request falls outside an idle fuel request range.

15. The method of claim 14, wherein the idle fuel request range is determined based on one or more of a combustion mode of the engine, and a gear state of the transmission.

16. The method of claim 11, wherein an IFR is determined if the clutch control parameter is such that the clutch does not substantially impart load to the engine.

17. The method of claim 11, wherein an IFR is determined if the clutch is fully engaged and the vehicle transmission is in neutral.

18. The method of claim 11, wherein an IFR is determined if a fuel request during the idle condition falls outside an idle fuel request range and a clutch control parameter is below a clutch control parameter threshold.

19. The method of claim 11, further comprising implementing a control action subsequent to determining an IFR.

20. The method of claim 19, wherein the control action comprises notifying a vehicle operator of the IFR.

* * * * *